US005628349A

United States Patent [19]

Diggins et al.

[11] Patent Number: 5,628,349

[45] Date of Patent: May 13, 1997

[54] SYSTEM AND METHOD FOR DISPENSING PRESSURIZED GAS

[75] Inventors: David A. Diggins; Jack E. Brown, both of Midland, Tex.

[73] Assignee: Pinnacle CNG Systems, LLC, Midland, Tex.

[21] Appl. No.: 377,975

[22] Filed: Jan. 25, 1995

[51] Int. Cl.[6] ..... B65B 1/04; B65B 3/04

[52] U.S. Cl. ..... 141/3; 141/5; 141/83; 141/95

[58] Field of Search ..... 141/3, 4, 5, 18, 141/21, 83, 198, 94, 95; 220/562, 565; 137/552, 554

[56] References Cited

U.S. PATENT DOCUMENTS

| | | | |
|---|---|---|---|
| 3,837,377 | 9/1974 | McJones | 141/4 |
| 4,240,381 | 12/1980 | Lowther | 123/26 |
| 4,515,516 | 5/1985 | Perrine et al. | 417/38 |
| 4,527,600 | 7/1985 | Fisher et al. | 141/4 |
| 4,966,206 | 10/1990 | Baumann et al. | 141/83 |
| 4,984,457 | 1/1991 | Morris | 73/149 |
| 5,029,622 | 7/1991 | Mutter | 141/4 |
| 5,156,198 | 10/1992 | Hall | 141/94 |
| 5,169,295 | 12/1992 | Stogner et al. | 417/339 |
| 5,238,030 | 8/1993 | Miller et al. | 141/4 |
| 5,259,424 | 11/1993 | Miller et al. | 141/4 |
| 5,351,726 | 10/1994 | Diggins | 141/4 |
| 5,454,408 | 10/1995 | Dibella et al. | 141/18 |

*Primary Examiner*—Henry J. Recla
*Assistant Examiner*—Timothy L. Maust
*Attorney, Agent, or Firm*—Gardere & Wynne, L.L.P.

[57] ABSTRACT

A system and method for dispensing pressurized gas, especially CNG, in which the temperature inside the receiving tank is preferably monitored and is used by a computer to adjust the fill pressure to compensate for the temperature and pressure rise attributable to adiabatic compression of the gas inside the receiving tank. The system also utilizes the temperature and pressure of the receiving tank to calculate the volume of gas dispensed.

37 Claims, 11 Drawing Sheets

SYSTEM AND METHOD FOR DISPENSING PRESSURIZED GAS

BACKGROUND OF THE INVENTION

1. Field of the Invention

This invention relates to a pressurized gas dispensing system and more particularly to a method and apparatus useful for transferring compressed natural gas ("CNG") from a refueling station into one or more vehicle storage tanks.

2. Description of Related Art

Systems for compressing and dispensing natural gas are well known, having previously been disclosed for example in U.S. Pat. Nos. 3,837,377; 4,515,516; 4,527,600; 4,966,206; 5,029,622; 5,169,295; 5,238,030; 5,259,424; and 5,351,726.

Because of the interrelationship between the temperature, pressure and volume of gases, the amount of CNG that can safely be introduced into a storage tank such as a vehicle storage tank during refueling necessarily depends upon factors such as the volume and design pressure of the tank, and the temperature and pressure of the gas inside the tank. Industry convention sets the pressure rating for CNG fuel tanks at the standard temperature of 70° F., so nominal pressure ratings such as 2400, 3000 and 3600 psi correspond to an internal gas temperature of 70° F. During rapid refueling, the internal tank temperature will typically rise about 70° F. due to adiabatic compression of the gas. After the tank is filled, the temperature and pressure inside the tank will normally decrease as the gas cools. Wide variations in ambient temperature above or below the standard condition of 70° F. can also have a significant effect on the indicated pressure inside the tank during and after refueling. In addition to safety considerations, the effects of temperature and pressure on the volume of gas dispensed during refueling are also important for billing or cost accounting purposes.

Prior art CNG refueling systems have used various devices and methods for regulating the cutoff pressure and for determining the amount of gas dispensed when refilling vehicle storage tanks. U.S. Pat. No. 3,837,377 discloses means for sensing the pressure of a given amount of reference gas contained in a closed reference pressure vessel that is in thermal contact with the tank being filled. Gas is charged into the tank and the pressure in both the reference vessel and the tank are monitored and compared. Refueling is terminated whenever there is a predetermined pressure differential between the gases in the reference vessel and the tank. The use of an internal reference vessel increases fabrication and installation costs and also presents an ongoing maintenance problem with regard to checking the integrity of the reference vessel. If the reference vessel leaks, there is no way to verify that the reference pressure is correct and has not changed. Also, the use of a reference vessel as disclosed in U.S. Pat. No. 3,837,377 will not provide a desirably quick response time in that the gas flow rate will be gradually lowered as the receiving tank pressure begins approaching the reference pressure.

U.S. Pat. No. 4,527,600 discloses a CNG dispensing system comprising a relatively high pressure storage tank from which CNG flows through a control valve, pressure regulator and flow sensing transducer to the tank being filled. Temperature and pressure transducers in the storage tank transmit electric signals to a process control computer that calculates the volume of gas dispensed by comparing the initial and final values of the CNG inside the storage tank. A differential pressure cell communicating with the storage tank and with the vehicle tank fill line generates a signal that is used by the computer to operate a solenoid-controlled valve disposed in the fill line. Flow continues until pressure in the vehicle storage tank reaches a preselected set point, causing the regulator to close. The regulator set point is not, however, adjusted according to the temperature inside the vehicle tank.

U.S. Pat. No. 5,029,622 discloses a gas refueling device and method of operation wherein at least one temperature sensor is utilized for sensing the temperature of ambient air external to the refueling device and generating a first actual value signal while the pressure sensor senses the pressure of the gas flow in the gas distribution means and generates another actual value signal in response thereto. An advantage of this refueling device is said to be that set/actual value comparisons between pressures and temperatures are carried out at short time intervals, with the permissible set values being corrected according to the development of the preceding measurements. Here again, however, the temperature inside the vehicle storage tank is not monitored during refueling.

U.S. Pat. No. 4,966,206 discloses another device for refilling tanks with CNG that automatically adjusts the filling pressure of the gaseous fuel to the local ambient temperature. A temperature sensor is disposed outside the casing of the device for generating a signal in response to ambient temperature. A pressure sensor is connected to the suction line of the compressor for generating a signal in response to the gas inlet pressure. A pressure difference sensor is also provided for generating a signal in response to a difference in pressure between the fuel pressure in the inlet line of the casing and the pressure inside the casing. A control device disposed in the casing is connected to each of the three sensors in order to receive signals from each. This control device is also connected to the inlet valve and discharge valve in order to control the inlet valve and discharge valve in response to the signals received from the sensors.

U.S. Pat. No. 5,238,030 discloses a pressurized fluid dispensing system that can automatically compensate for non-standard ambient gas temperature to promote complete filling of a pressurized storage tank. Pressure and temperature transducers connected to the supply plenum measure the stagnation pressure and temperature of the CNG, and a pressure transducer in fluid communication with the vehicle tank via the dispensing hose assembly is used to determine the pressure in the vehicle tank. A second temperature transducer is used to measure the ambient temperature. An electronic control system connected to the pressure and temperature transducers and to the control valve assembly calculates a vehicle tank cut-off pressure based on the ambient temperature and on the pressure rating of the vehicle tank that has been pre-programmed into the electronic control system and automatically turns off the CNG flow when the pressure in the vehicle tank reaches the calculated cut-off pressure.

U.S. Pat. No. 5,259,424, related to U.S. Pat. No. 5,238,030, discloses a similar system in which the pressure transducer is used to determine the discharge pressure; in which the electronic control system calculates the volume of the vehicle tank and the additional mass of CNG required to increase the tank pressure to the cut-off pressure; and in which the CNG flow is turned off when the additional mass has been dispensed into the vehicle tank.

SUMMARY OF THE INVENTION

Unlike systems disclosed in the prior art that measure the pressure inside a reference vessel, the ambient temperature, or the temperature of the gas as it is being dispensed, the present system is based on measuring the temperature inside a receiving tank such as a CNG storage tank mounted on a vehicle. According to one preferred embodiment of the invention, a compressed gas dispensing system is provided that comprises a pressurized gas source; a receiving tank; means for monitoring temperature inside the tank and the pressure of gas introduced into the tank; a computer programmed to read the vehicle identification number tank water volume, temperature and pressure data, to calculate volumes, pressures and temperatures for the gas based on such data, and to control the flow of pressurized gas in response to such data and calculated values; means for digitizing and communicating the vehicle identification number tank water volume, temperature and pressure data to the computer; and means for selectively controlling the flow of gas from the pressurized gas source into the receiving tank. According to a particularly preferred embodiment of the invention, a conventional thermocouple or other temperature measuring device is installed so as to sense temperature changes near the center of the tank. In one preferred vehicular CNG refueling system, the tank temperature data is communicated through the vehicle data module to the computer controlling the dispensing system. In another embodiment of the invention, the tank temperature data is transmitted to the computer through a hard-wired connection utilizing a jack installed on the vehicle.

According to another embodiment of the invention, a method is provided for dispensing pressurized gas from a pressurized gas source into a receiving tank, the method comprising the steps of releasably connecting to the tank a gas flow conduit communicating with the pressurized gas source; receiving and storing in a computer data relating to the water volume and maximum rated pressure of the tank; calculating the volume of gas the tank will hold at the rated pressure and 70° F.; reading the initial tank temperature and pressure; calculating and storing the initial volume of gas in the tank; estimating the finish temperature and pressure; initiating the flow of pressurized gas into the tank; monitoring the actual tank temperature and gas pressure; recalculating the volume of gas in the tank; determining whether the volume of gas in the tank is less than or equal to the standard cubic feet of gas the tank will hold at the rated pressure; and terminating the flow of pressurized gas into the tank whenever the volume of gas in the tank reaches the desired level relative to the standard cubic feet of gas the tank will hold at the rated pressure. According to one particularly preferred embodiment of the invention, the receiving tank is filled rapidly until the tank pressure is within about 200 psi of the estimated finish pressure, and is then filled more slowly until filling is completed and the gas flow is terminated.

With the system and method disclosed herein, the computer repeatedly adjusts the estimated final fill pressure as necessary to compensate for any adiabatic heat gain during the refueling process. This technique insures that each refilled tank receives the maximum safe fuel load, which will desirably not exceed the manufacturer's recommended maximum operating pressure. At no time during the dispensing cycle should the actual pressure inside the receiving tank exceed the manufacturer's maximum allowable pressure for that tank. The volume of gas dispensed during refilling is preferably determined as the difference between the final and initial gas volumes inside the receiving tank as calculated by the system computer.

Other optional features of the automated vehicle filling system of the invention include automatic vehicle identification and refueling authorization; a valve sequence for maximizing fill rate by avoiding a decreasing flow rate as the finish pressure is reached; display of current driving range in miles based on MPG calculated from last fill-up; the ability to measure the volume of gas dispensed in any desired units, including standard cubic feet (SCF), British thermal units (BTU), therms, decatherms, gasoline gallon equivalents (GGE); and a determination of the cost or charge for the gas dispensed.

According to another embodiment of the invention, a system and method are also disclosed for simultaneously "slow filling" or "time filling" a plurality of receiving tanks with a pressurized gas through a plurality of hoses connected to a single manifold. A system of this type might be used, for example, by a fleet operator in situations where numerous vehicles are kept and serviced in a common maintenance area. With this embodiment of the invention, a hose is preferably connected to each vehicle when it is parked in the refueling area, and refueling continues until the receiving tanks in all vehicles have reached the desired pressure level. When tanks are slow-filled according to this embodiment of the invention, any adiabatic heat gain inside the tank during refueling is dissipated through the tank wall so that the internal tank temperature remains close to the ambient temperature and it is not necessary to adjust the estimated finish pressure to compensate for adiabatic heat gain. The estimated finish pressure is instead determined by adjusting the manufacturer's maximum allowable operating pressure for the tank at standard conditions according to the extent by which the ambient temperature during refueling varies from 70° F. In this application of the invention, transducers are desirably provided to measure temperature and pressure inside each receiving tank to permit calculation of initial and final gas volumes at standard conditions.

This invention replaces conventional sonic and micromotion CNG dispensing equipment at a much lower unit cost. Conventional dispensing and measuring equipment is limited to a very narrow range of flow rate. The micromotion dispensers and measuring equipment must desirably demonstrate an accuracy of plus or minus two percent of the actual mass of gas dispensed. This accuracy can only be maintained within a fairly narrow flow rate range of approximately plus or minus 33 percent of its design capacity. If unregistered gas rates exceed the design capacity of the meter, the gas must be throttled by means of a choke. Likewise, if the gas flow rate falls below the lower limit of acceptable accuracy, the flow of gas must be stopped until sufficient gas pressure is reached to give a flow rate within the range of accuracy. Because the system disclosed herein does not need to measure the gas flow rate, it is totally independent of any flow rate restrictions. It can therefore measure the volume of gas transferred at any rate and is only limited in accuracy by the devices used to measure the beginning and ending temperature and pressure of gas within the vehicle fuel tank.

BRIEF DESCRIPTION OF THE DRAWINGS

The subject system and its method of operation are further described and explained in relation to the following figures of the drawings wherein.

DESCRIPTION OF THE PREFERRED EMBODIMENTS

Figure 1:
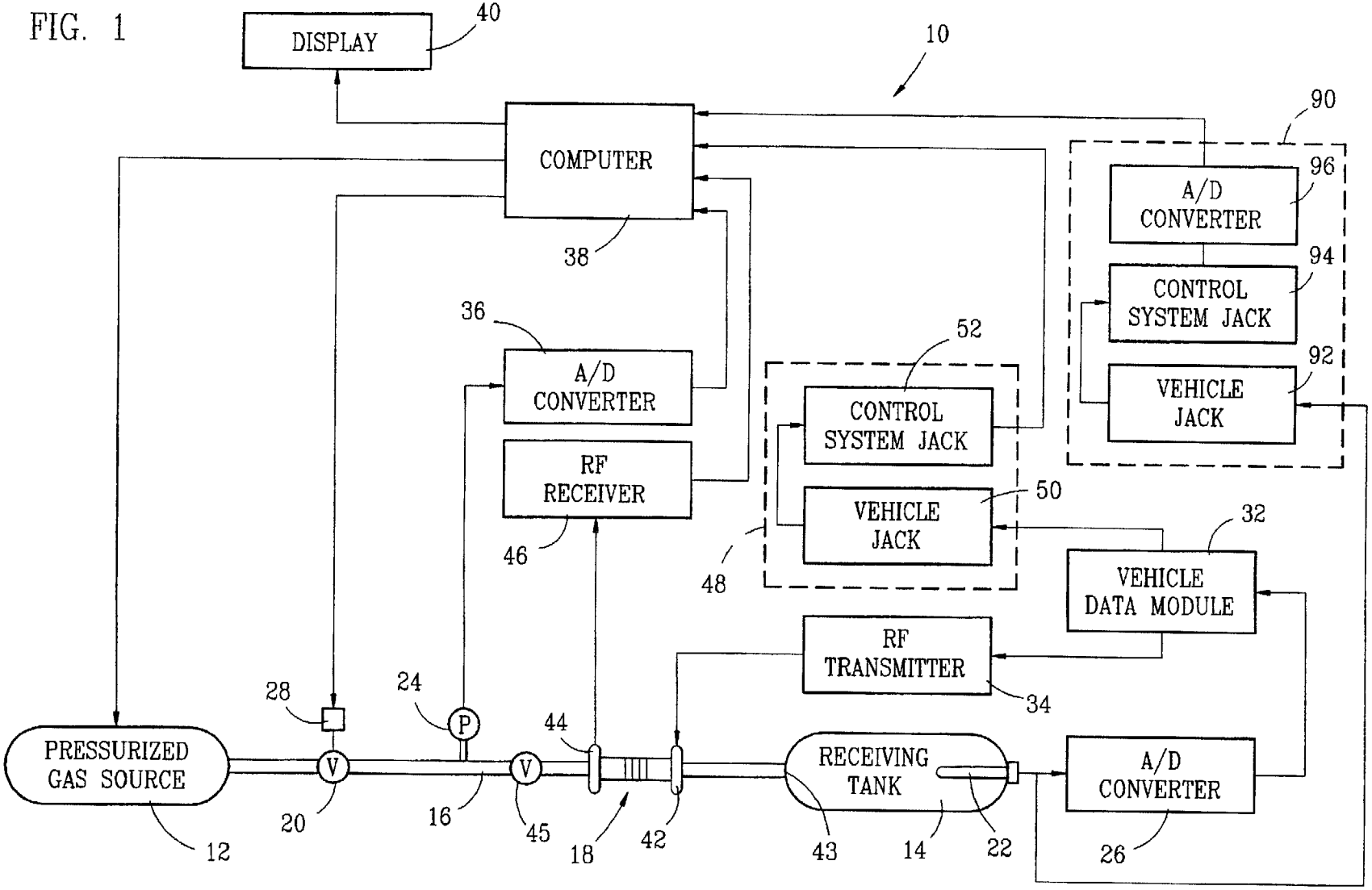
FIG. 1 is a simplified schematic view of one preferred embodiment of the pressurized gas dispensing system of the invention as adapted for use as a CNG refueling system for motor vehicles, also showing two alternate apparatus configurations for transmitting temperature and pressure data from the receiving tank to the system computer.
Figure 2A:
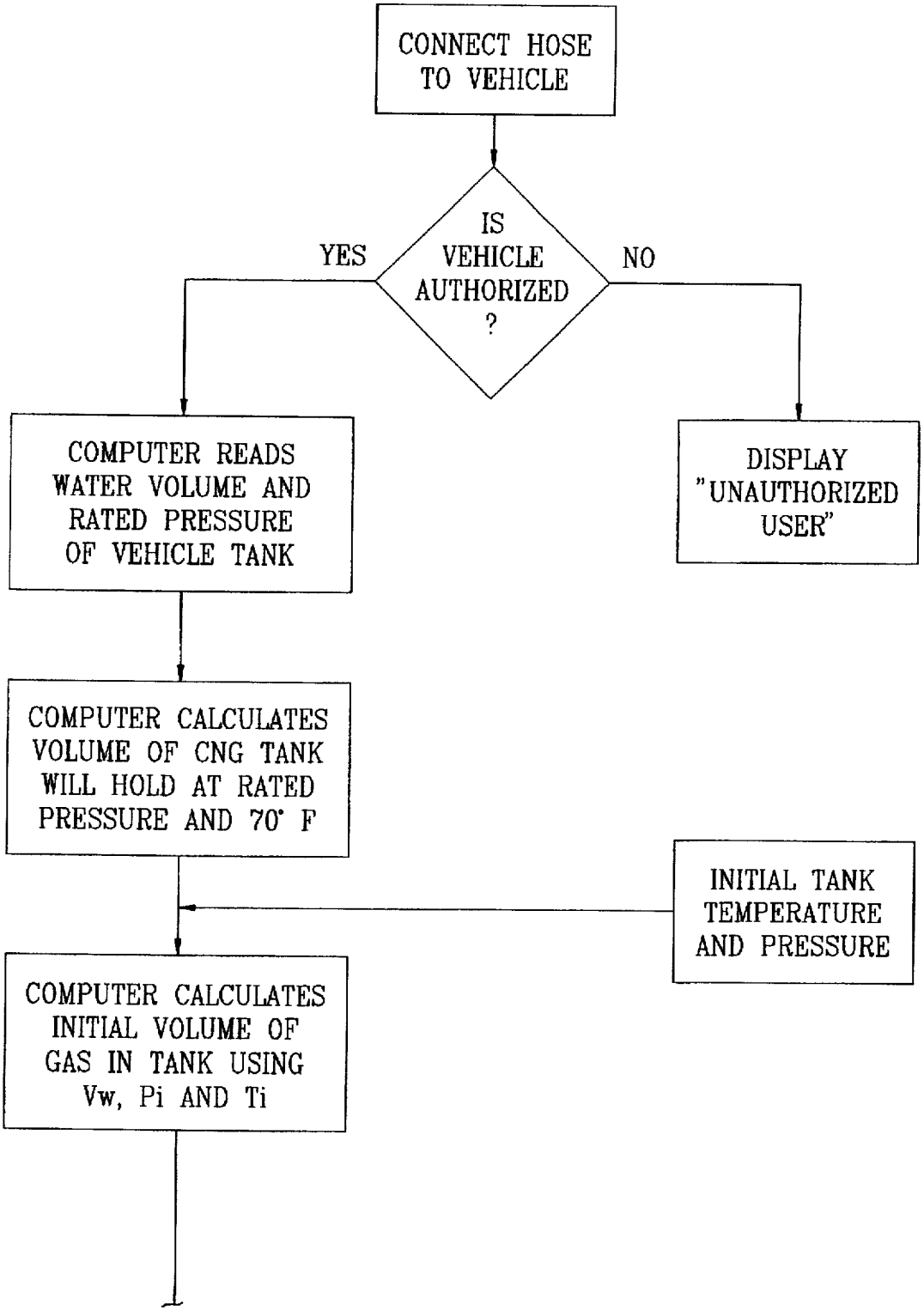
FIGS. 2A, 2B, 2C and 2D collectively comprise a simplified block flow diagram illustrating the steps of the preferred CNG refueling method of the invention as practiced using the system of FIG. 1.
Figure 2B:
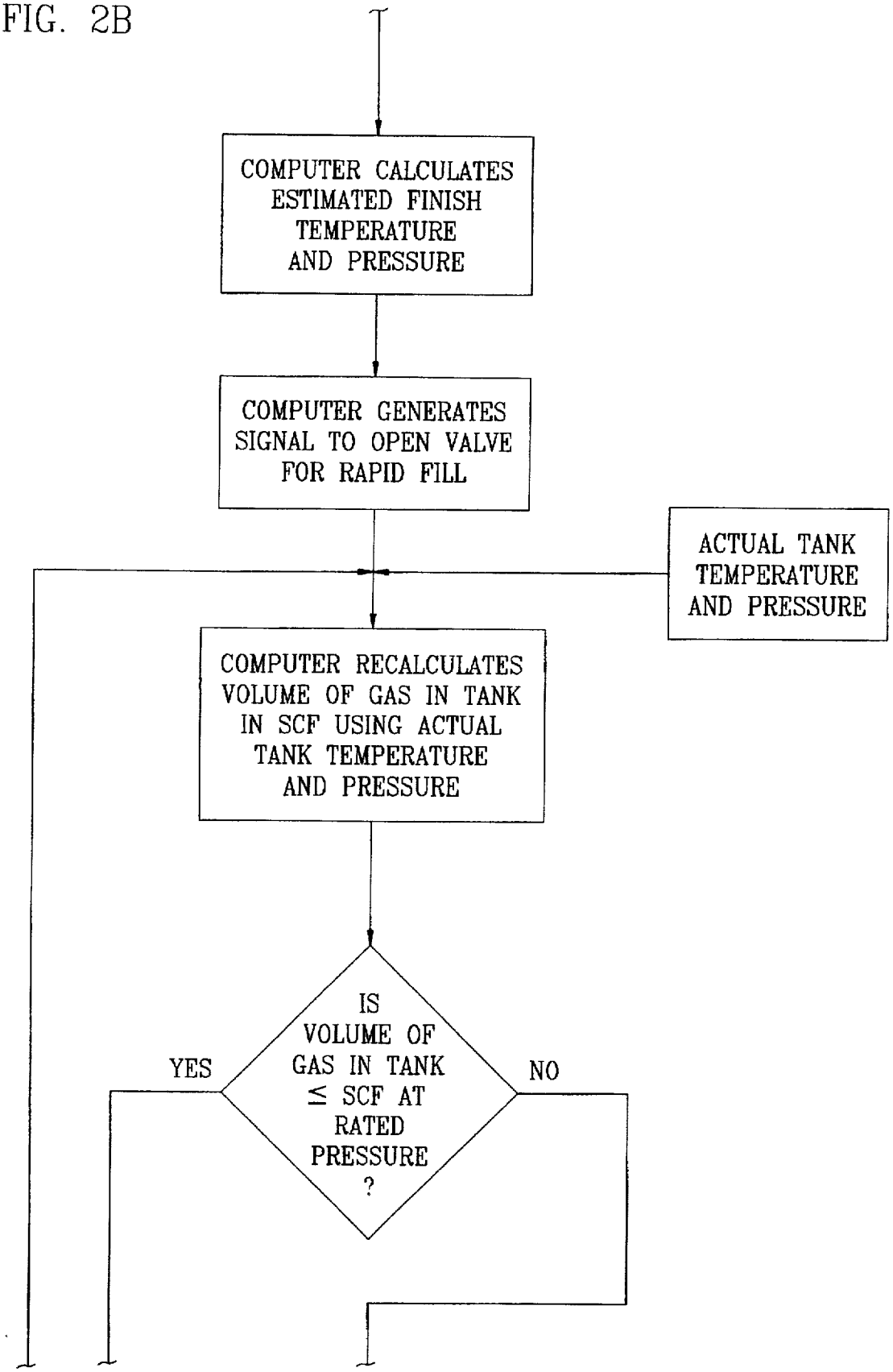
Figure 2C:
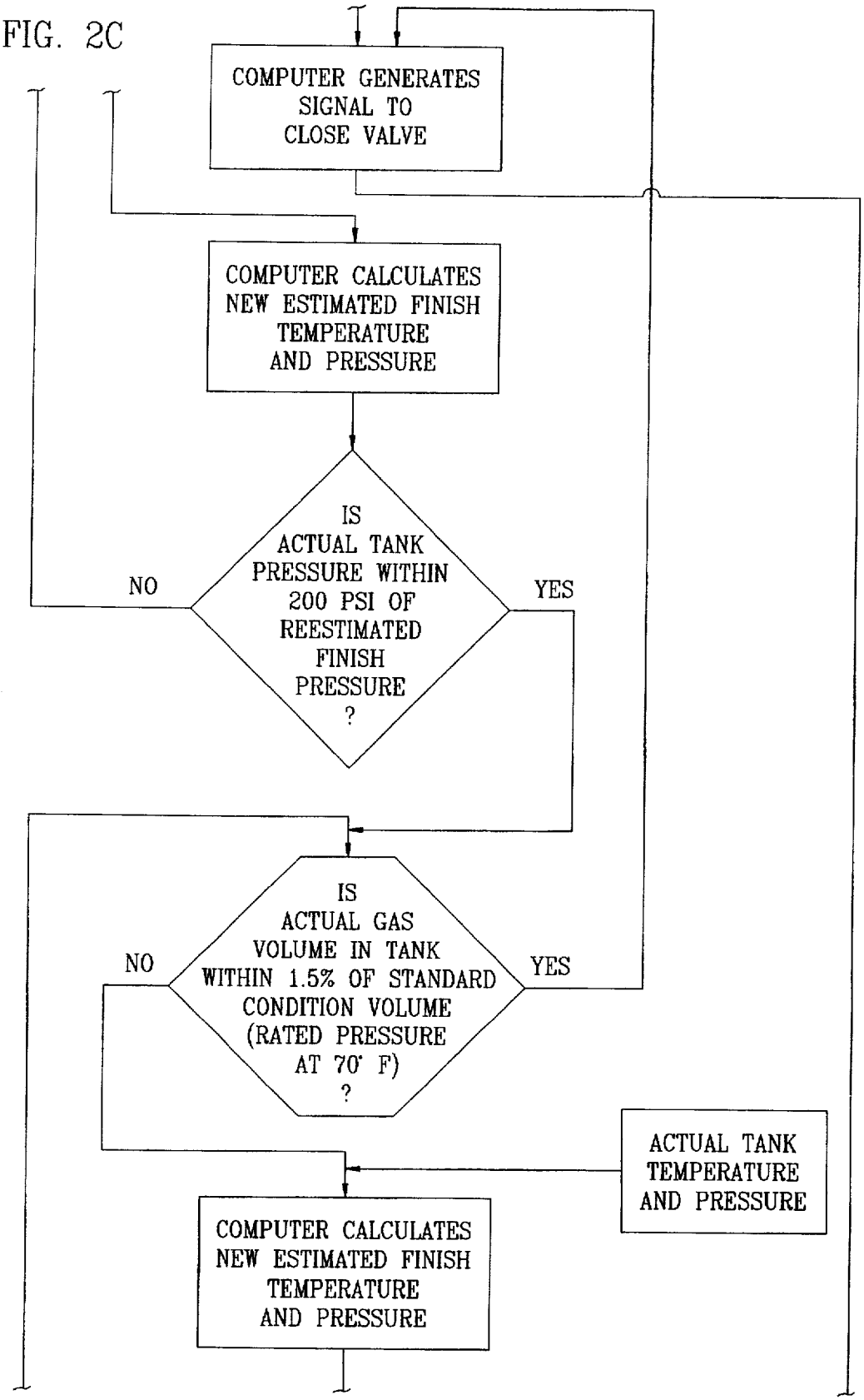
Figure 2D:
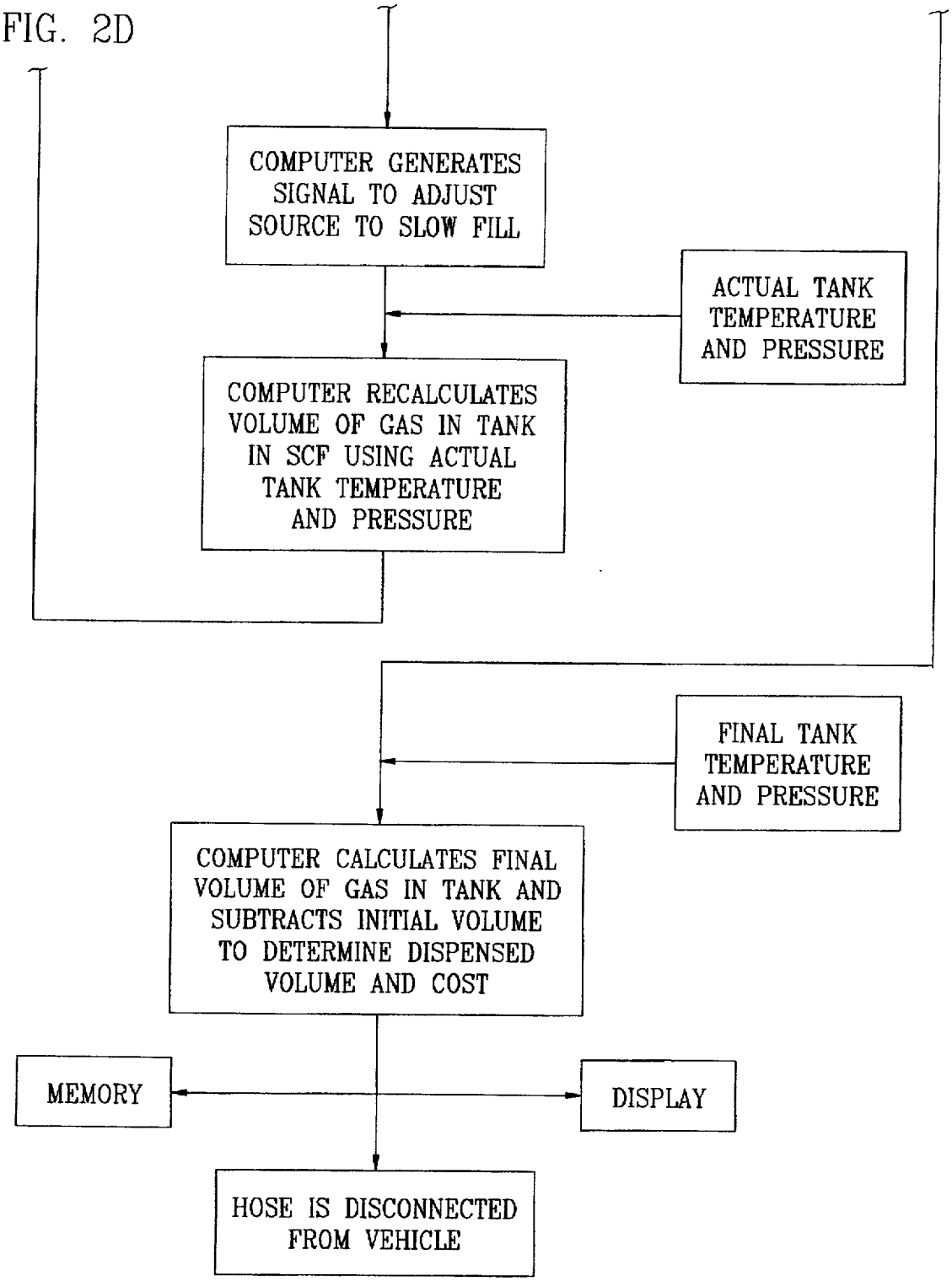

Referring to FIG. 1, system 10 of the invention preferably comprises pressurized gas source 12 connected to receiving tank 14 through pressurized gas flow line 16 and releasable hose connector assembly 18; gas supply valve 20, three way vent valve 45 and pressure transducer 24 disposed in gas flow line 16 to control the flow of pressurized gas between gas source 12 and receiving tank 14; temperature transducer 22 disposed inside receiving tank 14; analog-to-digital converters 26, 36; system computer 38; and display 40. Gas supply valve 20 is preferably a two position valve that is selectively opened and closed by electronically actuated solenoid 28 in response to signals received from computer 38. A typical response time for valve 20 is about 120 microseconds. Solenoid 28 can be hard-wired to computer 38 as shown in FIG. 1, or can be actuated by a remote transmitter if desired. Although a principal use of the system and method of the invention is for refueling vehicle storage tanks with compressed natural gas, it will be apparent upon reading the specification that the present system is similarly useful for refilling other types of gas storage tanks with pressurized gas.

Pressurized gas source 12 can be a large volume storage tank, a pressurized gas supply line, a compressor discharge line, or any combination of these elements suitable for use in supplying gas to receiving tank 14 in an amount and at a pressure great enough to achieve the desired fill rate, fill level and pressure. A particularly preferred gas source 12 for supplying pressurized gas to receiving tank 14 is a system as shown and described in U.S. Pat. No. 5,351,726, which is incorporated by reference herein. It should be understood for purposes of the present invention that pressurized gas source 12 can include both rapid-fill and slow-fill sources, together with means for controlling the source from which the gas is supplied in response to signals generated by computer 38. The term "rapid-fill" is generally understood to apply to fill rates exceeding about 200 cfm per tank, while the term "slow-fill" is generally understood to apply to fill rates below 200 cfm per tank, and usually to flow rates of about 30 cfm per tank or lower. It will be appreciated of course that "rapid-fill" and "slow-fill" are relative terms and that the flow rates associated with those terms can vary substantially according to the capacity of the gas supply line and according to the number and volume of receiving tank(s) being filled in a particular application. The flow rates mentioned above are exemplary of those that might reasonably be utilized in the "rapid-fill" or "slow-fill" of vehicle storage tanks such as pickup or automobile CNG storage tanks. For systems as disclosed herein in relation to the preferred embodiments of the invention, "rapid-fill" is primarily utilized when refilling a single tank, as described herein with reference to FIGS. 1 and 2, whereas "slow-fill" is primarily utilized when simultaneously refilling a plurality of tanks as described herein with reference to FIGS. 3, 4 and 9.

Figure 8:
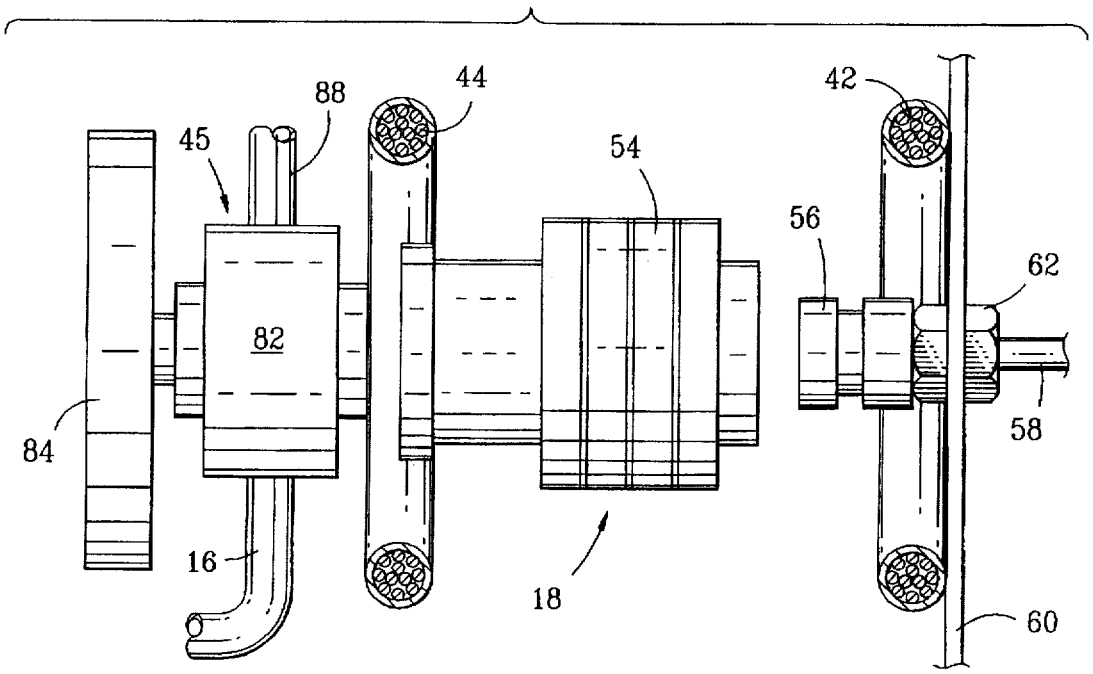
FIG. 8 is a detail elevation view of a preferred hose connector assembly for use in the invention, the assembly comprising RF antenna loops for use in transmitting vehicle identification information and temperature and pressure data from the vehicle to the computer controlling the refueling system.

Three-way vent valve 45 and a preferred hose connector assembly 18 (disconnected) are shown and further described in relation to FIG. 8 of the drawings. Referring to FIG. 8, hose connector assembly 18 preferably comprises male connector 56 communicating with vehicle tank supply line 58 attached to vehicle panel 60 by nut 62, and spring-loaded female connector 54 attached to gas flow line 16. Female connector 54 and male connector 56 both preferably comprise integral check valves (not visible in FIG. 8) that are locked open whenever the connection is made. Three-way vent valve 45 is preferably installed at the dispensing island or refueling dock just upstream of hose connector assembly 18. Valve 45 preferably comprises valve body 82 containing a valve member that is actuated by rotating handle 84 to selectively establish fluid communication between gas flow line 16 and either tank supply line 58 or vent line 88, or alternatively, to block fluid communication between gas flow line 16 and tank supply line 58. By selectively rotating valve handle 84 to the vent position after refueling, the operator is able to relieve the gas pressure inside hose connector assembly 18 to permit disengagement of female connector 54 from male connector 56. Three-way vent valve 45 and quick-connect hose connector assembly 18 (meeting the requirements of NGV II rules) are commercially available from well known industry vendors such as Stäbli, Swagelok, Parker Hannefin and Hoke Gyrolok. According to one preferred embodiment of the invention, RF antenna loops 42, 44 are attached to male and female connectors 56, 54, respectively, and as hose connector assembly 18 is connected, the two RF antennae are brought close enough that data transfer can occur as discussed in greater detail below.

Pressure transducer 24 is desirably disposed in gas flow line 16 between supply valve 20 and three way vent valve 45, and generates a signal corresponding to the line pressure that is forwarded through analog-to-digital converter 36 to computer 38. Once gas flow line 16 has be placed in fluid communication with receiving tank 14 by making the connection at hose connector assembly 18 and by manually opening valve 45, and before valve 20 is opened, pressure transducer 24 is able to measure the initial pressure in receiving tank 14 (although the initial pressure in receiving tank 14 will rise slightly when valve 45 is opened after making the connection at hose connector assembly 18).

Figure 5:
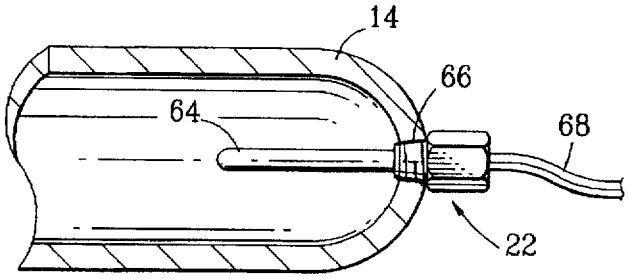
FIG. 5 is a cross-sectional detail view of one end of a gas receiving tank suitable for use in the present invention, showing a thermowell and thermocouple installed in the end of the tank opposite the gas inlet.
Figure 6:
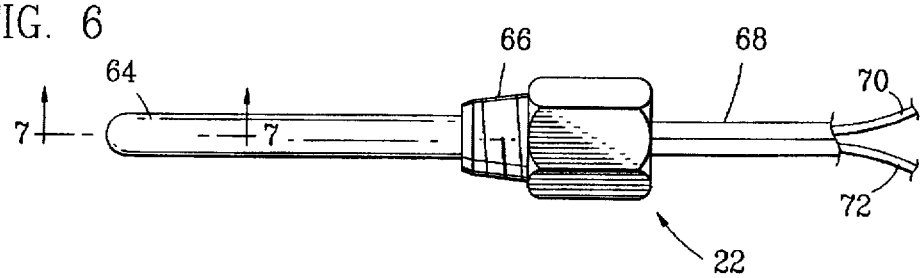
FIG. 6 is a detail front elevation view of the thermowell shown in FIG. 5, with the thermocouple wires extending outwardly from the thermowell.
Figure 7:
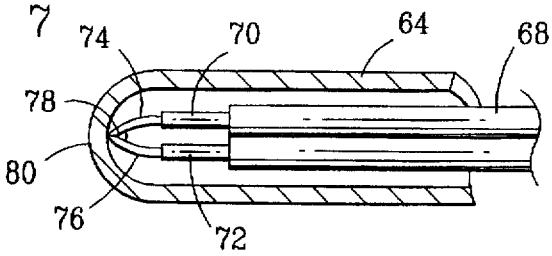
FIG. 7 is a detail cross-sectional elevation view, taken along line 7—7 of FIG. 6, depicting the interiorly facing end of the thermowell of FIGS. 5 and 6, showing the placement of the thermocouple bead relative to the inside wall of the thermowell.

A significant feature of the present invention is the disposition of temperature transducer 22 inside receiving tank 14. A preferred temperature transducer 22 for use in the present invention is further described and explained in relation to FIGS. 5–7. Referring to FIGS. 5–7, temperature transducer 22 is desirably made of 304 stainless steel and is secured by threads 66 to an orifice in the end wall of receiving tank 14 that is opposite fuel inlet port 43 as shown in FIG. 1. The free end of probe portion 64 of temperature transducer 22 desirably extends inside receiving tank 14 to a point at or near the centroid of the tank, or at least along the centerline of the tank, in order to obtain temperature data that is representative of the gas temperature inside the tank. Referring to FIGS. 6 and 7, probe portion 64 of temperature transducer 22 is desirably a tubular member having a closed end with a wall thickness that is relatively thin when compared to the wall thickness of receiving tank 14. Wire 68 comprising electrical conductors 70, 72 preferably extends into probe portion 64, and wire filaments 74, 76 attached to conductors 70, 72, respectively, are joined to each other at bead 78, which is also grounded to the interior surface of end wall 80 of probe portion 64.

Measurement of the temperature inside receiving tank 14 offers several advantages over the prior art systems. With the system disclosed herein, the volume of gas inside receiving tank 14 and the desired finish pressure can be determined or recalculated by computer 38 at any time based upon the actual temperature of the gas inside receiving tank 14. As used herein, the term "finish pressure" refers to the pressure inside receiving tank 14 whenever the gas fill level is within a predetermined range, preferably within about 1.5%, of the standard condition volume at the rated maximum standard condition pressure for the tank. With a commercially available pressure transducer having an accuracy of one quarter percent and a thermocouple having an accuracy of plus or minus 4° F., then the combined error should only be, for example, about 1.1 percent at 3,000 psi. At no time during the dispensing cycle should the actual pressure inside the receiving tank exceed the manufacturer's maximum allowable pressure for that tank.

The signal from temperature transducer 22 can be relayed to computer 38 by any of several conventional, commercially available devices or systems as desired. Three such alternative devices are depicted diagrammatically in FIG. 1. In two of the alternatives depicted in FIG. 1, the temperature data signal generated by temperature transducer 22 is routed first to analog-to-digital converter 26 and vehicle data module 32. (Although shown separately in FIG. 1, it is understood that converter 26 can be a part of the circuitry of vehicle data module 32.) According to one preferred embodiment of the invention, the signal for the digitized temperature data is directed through RF transmitter 34 to antenna 42, and then picked up by antenna 44 and directed through RF receiver 46 to computer 38.

According to another embodiment of the invention, referring again to FIG. 1, the signal from temperature transducer 22 can alternately be routed to system computer 38 through a hard-wired connection utilizing releasably interconnectable vehicle jack 50 and control system jack 52, both of which are depicted schematically inside dashed boundary 48. Jacks 50, 52 can be built into the respective male and female connectors 56, 54 of hose connector assembly 18 or can be situated at any other point reasonably accessible to the operator during refueling.

According to yet another embodiment of the invention, referring again to FIG. 1, the signal from temperature transducer 22 can alternately be routed to system computer 38 through a hard-wired connection utilizing releasably interconnectable vehicle jack 92 and control system jack 94 and through analog-to-digital converter 96, which are depicted schematically inside dashed boundary 90. Jacks 92, 94 can be built into the respective male and female connectors 56, 54 of hose connector assembly 18 or can be situated at any other point reasonably accessible to the operator during refueling.

In CNG refueling operations, point of sale authorization or fuel pump security in a self-serve fleet operation can be controlled by a credit card or "card lock" system. With some prior art systems, each employee or customer is issued a magnetic card and assigned a personal identification ("PIN") number. After the magnetic card is scanned, the person requesting fuel is asked to enter the PIN number. The PIN number helps prevent unauthorized use of the magnetic card, but falls short of securing fuel from unauthorized use. For example, an employee having a magnetic card and PIN number can fuel an unauthorized vehicle or an unauthorized auxiliary container even with the card lock system in place. At best, record keeping is difficult, particularly if vehicles are rotated or reassigned to other operators.

The CNG refueling system 10 disclosed herein is desirably adapted to incorporate a vehicle point of sale authorization feature that eliminates any employee input of data. According to one embodiment of the invention, the vehicle data module of each vehicle is desirably programmed to transmit to computer 38 a discrete alphanumeric identification code such as, for example, the 14 character manufacturer's vehicle identification number. The water volume, maximum allowable pressure and maximum operating pressure for receiving tank 14 can also be transmitted to system computer 38 at this time if not already stored in the computer's memory (or as a crosscheck against the values stored in memory). The transmitted code must match up with one of a list of preauthorized codes in the system computer 38 in order to initiate the refueling cycle, thereby providing very reliable security against unauthorized use. Additionally, the vehicle data module can be programmed to transmit back to the system computer other information such as, for example, the odometer readings for the respective mileage driven under gasoline or CNG power, engine hours for both fuels, and the like. According to one particularly preferred embodiment of the invention, the transmitter, receiver and antennae used for this purpose are the same transmitter 34, receiver 46 and antennae 42, 44 described above for use in transmitting temperature data for receiving tank 14. The error-free transmission distance is preferably controlled so that the communication between the vehicle and fuel hose is broken if the fuel hose is disconnected from the vehicle. The communication between the vehicle and fuel hose is continuously monitored during fueling and the fuel dispenser is turned off if the signal is lost. This prevents the system from dispensing CNG to anything other than an authorized vehicle. Alternatively, if a jack system as represented inside dashed outline 48 of FIG. 1 is used for transmitting temperature data to computer 38 through vehicle data module 32, then other information such as vehicle identification data, tank water volume, manufacturer's pressure ratings, and the like, can also be transmitted to system computer 38 using this data link.

The relationship between pressure, volume and temperature for CNG is governed by the Ideal Gas Law as corrected for the supercompressibility of natural gas, which can be stated as follows:

$$P = \frac{ZnRT}{V}$$

Where:

P=pressure

Z=supercompressibility factor n=number of moles of gas present

R=Universal Gas Constant

T=temperature (°R)

V=cubic feet

The present invention takes into account the actual temperature inside receiving tank 14 and utilizes computer 38 to continuously adjust the final fill pressure to compensate for the adiabatic heat gain during the refueling process. Computer 38 preferably receives the initial temperature from transducer 22 inside receiving tank 14 and the initial pressure from transducer 24, and then calculates the initial volume of the gas in tank 14 using the equation:

$$V_i = \frac{P_i Z_b T_b V_T}{Z_i T_i P_b}$$

Where:

$V_i$=volume of gas in receiving tank at start of fill (SCF)

$P_i$=pressure of gas in receiving tank at start of fill (PSIA)

Z=supercompressibility factor of CNG at base conditions $T_b$=temperature base (520° R)

$V_T$=volume of receiving tank (CF)

$Z_i$=supercompressibility factor of CNG at start of fill $T_i$=temperature of gas in receiving tank at start of fill (R)

$P_b$=pressure base (14.69 PSIA for West Texas)

The method of the invention is further explained in relation to FIGS. 2A, 2B, 2C and 2D in the context of the apparatus previously described with regard to FIG. 1. Once the hose connection is established between pressurized gas source 12 and receiving tank 14 (and the vehicle and control system jacks are interconnected if using one of the alternative data transmission embodiments of FIG. 1) and valve 45 is opened, computer 38 first confirms from the list of vehicles retained in its memory that the vehicle is an authorized user, sending a message such as "Unauthorized User" to display 40 if it is not. After authorization is confirmed, computer 38 reads from its memory or receives from vehicle data module 32 of receiving tank 14 the water volume and rated pressure (preferably both the manufacturer's maximum allowable pressure and maximum operating pressure) for receiving tank 14. Computer 38 then calculates the volume of CNG that receiving tank 14 will hold at its maximum operating pressure at 70° F., reads the initial temperature in receiving tank 14 as determined by temperature transducer 22 and the initial pressure as determined by pressure transducer 24, calculates the initial volume of gas in receiving tank 14 using the water volume of the tank and the initial tank temperature and pressure, estimates the finish temperature and pressure for receiving tank 14, signals solenoid 28 to open valve 20, and signals pressurized gas source 12 to commence rapid filling of receiving tank 14.

During the refilling of receiving tank 14, temperature transducer 22 and pressure transducer 24 continue to forward real time temperature and pressure data to computer 38, which repeatedly recalculates the gas volume inside receiving tank 14 in standard cubic feet (cubic feet at standard conditions) at predetermined intervals. Computer 38 compares the volume calculated from the real time temperature and pressure inside receiving tank 14 with the previously calculated volume of gas that receiving tank 14 will hold at the maximum allowable operating pressure and 70° F. If the actual gas volume is still lower, computer 38 calculates a new estimated finish temperature and pressure and determines whether or not the actual tank pressure is within some predetermined range, preferably within about 200 psi, of the reestimated finish pressure. If the tank pressure is not yet within that range, rapid filling continues and computer 38 reads the new real time temperature and pressure data and calculates the volume of gas inside receiving tank 14, repeating the foregoing steps. (The stated predetermined range of about 200 psi is believed to be a satisfactory value for use in the method of the invention where a vehicular storage tank is being filled at a rapid-fill rate of about 200 cfm.)

If, on the other hand, the pressure in receiving tank 14 is already within 200 psi of the reestimated finish pressure, computer 38 next determines whether the actual gas volume in receiving tank 14 is within some predetermined range, preferably about 1.5%, of the volume the tank will hold at its rated pressure at 70° F. (The value of 1.5% is derived from the combined error ranges of temperature transducer 22 and pressure transducer 24.) If the volume of gas inside receiving tank 14 is within about 1.5%, computer 38 signals solenoid 28 to close valve 20. If not within about 1.5%, computer 38 again reads the real time temperature and pressure of receiving tank 14, calculates a new estimated finish temperature and pressure, and signals pressurized gas source 12 to switch from "rapid-fill" to "slow-fill." As previously mentioned, it will be understood by those of ordinary skill in the art upon reading this disclosure that the terms "rapid-fill" and "slow-fill" are simply intended as relative terms and that the particular flow rates associated with the terms can vary according to the capacities of the equipment utilized. While the concepts of using a two-tiered filling rate or a reduction in the flow rate as the volume of gas inside receiving tank 14 approaches its maximum capacity are desirable for use in the present invention, the particular approach followed for a given application is not critical to the inventive method of controlling a pressurized gas dispensing system according to the internal temperature and pressure of the receiving tank. It will also be appreciated upon reading this disclosure that hardware configurations other than those described above in relation to FIG. 1 can be utilized to implement the method of the invention. It is emphasized for reasons of safety that the estimated finish pressure should always be lower than the manufacturer's maximum allowable pressure for receiving tank 14 and that system computer 38 will generate a signal for solenoid 28 to close supply valve 20 at any time the pressure as measured by pressure transducer 24 exceeds the manufacturer's maximum allowable pressure for receiving tank 14 when adjusted for the actual tank temperature as measured by temperature transducer 22 inside tank 14.

During the "slow-fill" stage of the preferred CNG dispensing operation, computer 38 again reads the real time temperature and pressure received from temperature transducer 22 and pressure transducer 24, recalculates the volume of gas in receiving tank 14 in standard cubic feet using the actual tank temperature and pressure, and again determines whether or not the actual gas volume inside the receiving tank 14 is within about 1.5% of the standard condition volume (rated pressure at 70° F.). When receiving tank 14 has been filled to the desired level, computer 38 calculates the final volume of gas inside the tank and subtracts the initial volume to determine the volume of gas dispensed. Additional computations can be made regarding fuel usage, mileage, cost or the like, and the resultant data can be displayed as desired, stored electronically, or relayed back to vehicle data module 32 through a hard-wired connection such as that shown alternatively inside dashed line 48 in FIG. 1, or through another transmitter and receiver not depicted in FIG. 1. Three-way vent valve 45 is then turned to the vent position, releasing gas from hose connector assembly 18 through vent line 88 as seen in FIG. 8 to permit manual separation of the male and female connectors 56, 54. The check valves disposed inside hose connector assembly 18 prevent loss of pressurized gas from inside receiving tank 14 when hose connector assembly 18 is disconnected.

According to another embodiment of the invention, a system and method are also disclosed for simultaneously "slow-filling" or "time-filling" (terms used synonymously herein) a plurality of receiving tanks with a pressurized gas through a plurality of hoses connected to a single manifold. A system of this type might be used, for example, by a fleet operator in situations where numerous vehicles having receiving tanks with substantially the same pressure ratings are kept and serviced in a common area overnight. Because the receiving tanks are filled more slowly than with the embodiment of the invention previously described, the adiabatic heat is dissipated through the tank walls, and the temperature of the gas inside the receiving tanks remains close to the ambient temperature. Because tank sizes and initial fill levels will likely vary from vehicle to vehicle, however, temperature and pressure transducers are desirably provided for each receiving tank to permit the calculation of initial and final gas volumes for each tank.

Figure 3:
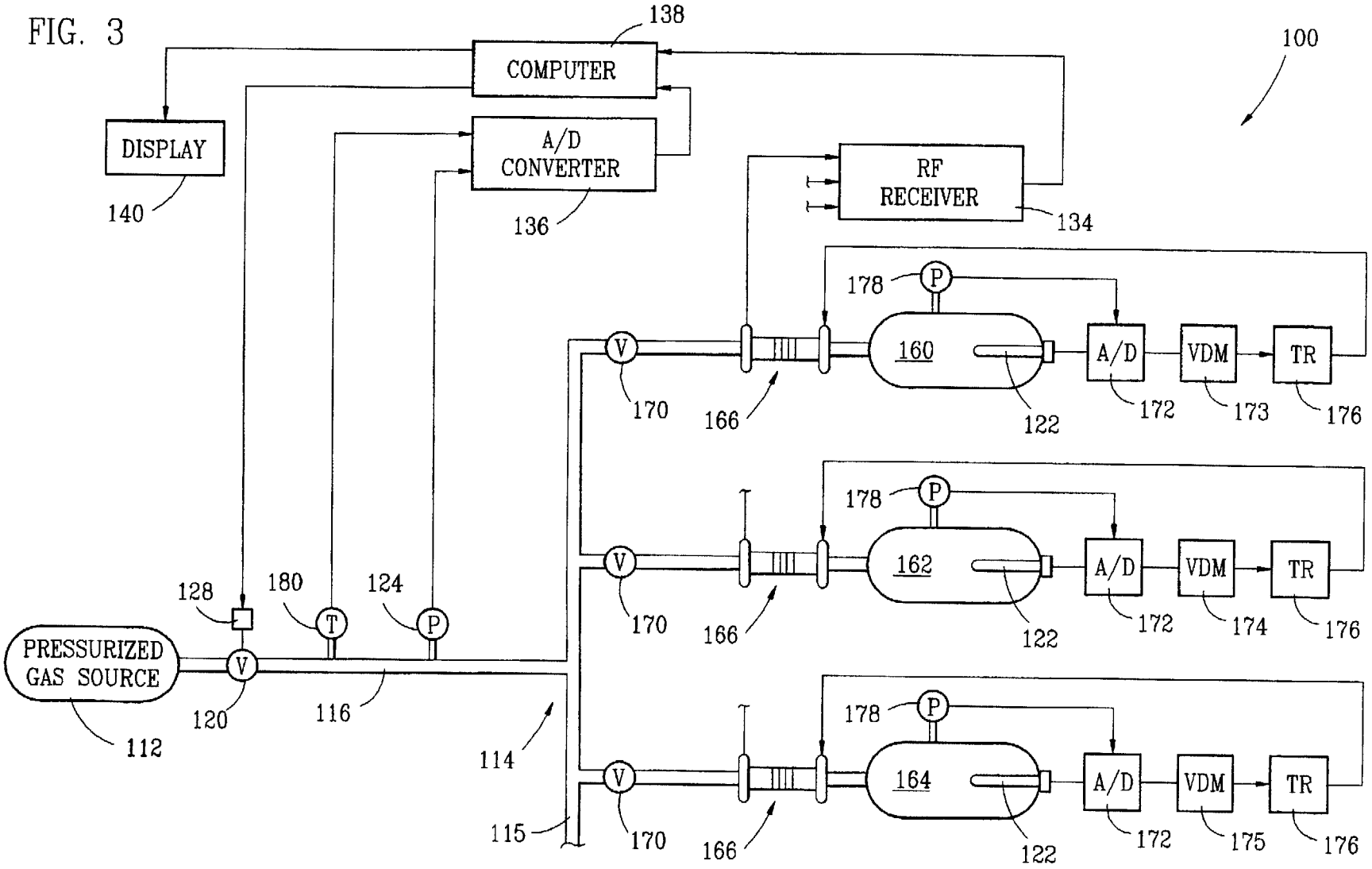
FIG. 3 is a simplified schematic view of another preferred embodiment of the compressed gas dispensing system of the invention as adapted for use in slow-filling a plurality of receiving tanks with a pressurized gas.

Referring to the preferred embodiment depicted in FIG. 3, system 100 of the invention preferably comprises pressurized gas source 112 connected to dispensing manifold 114 by gas flow line 116; three-way vent valves 170 and hose connector assemblies 166 for use in establishing gas flow communication between manifold 114 and receiving tanks 160, 162, 164; temperature transducers 122 disposed in each receiving tank and temperature transducer 180 installed in gas flow line 116; pressure transducers 178 installed in each receiving tank and pressure transducer 124 installed in gas flow line 116; analog-to-digital converters 172; vehicle data modules 173, 174, 175 for the various vehicles; RF transmitters 176; RF receiver 134; analog-to-digital converter 136; system computer 138; valve 120 disposed in gas flow line 116 and controlled by solenoid 128 in response to signals received from computer 138; and display 140. Hose connector assemblies 166 are desirably of the type previously described in relation to FIG. 8, which embody an RF antenna on both the male and female sides of the assemblies. Although only three receiving tanks 160, 162, 164 are shown in FIG. 3, it is understood that a plurality of additional tanks having substantially the same pressure ratings can likewise be connected to the manifold line 115 if desired.

Figure 4A:
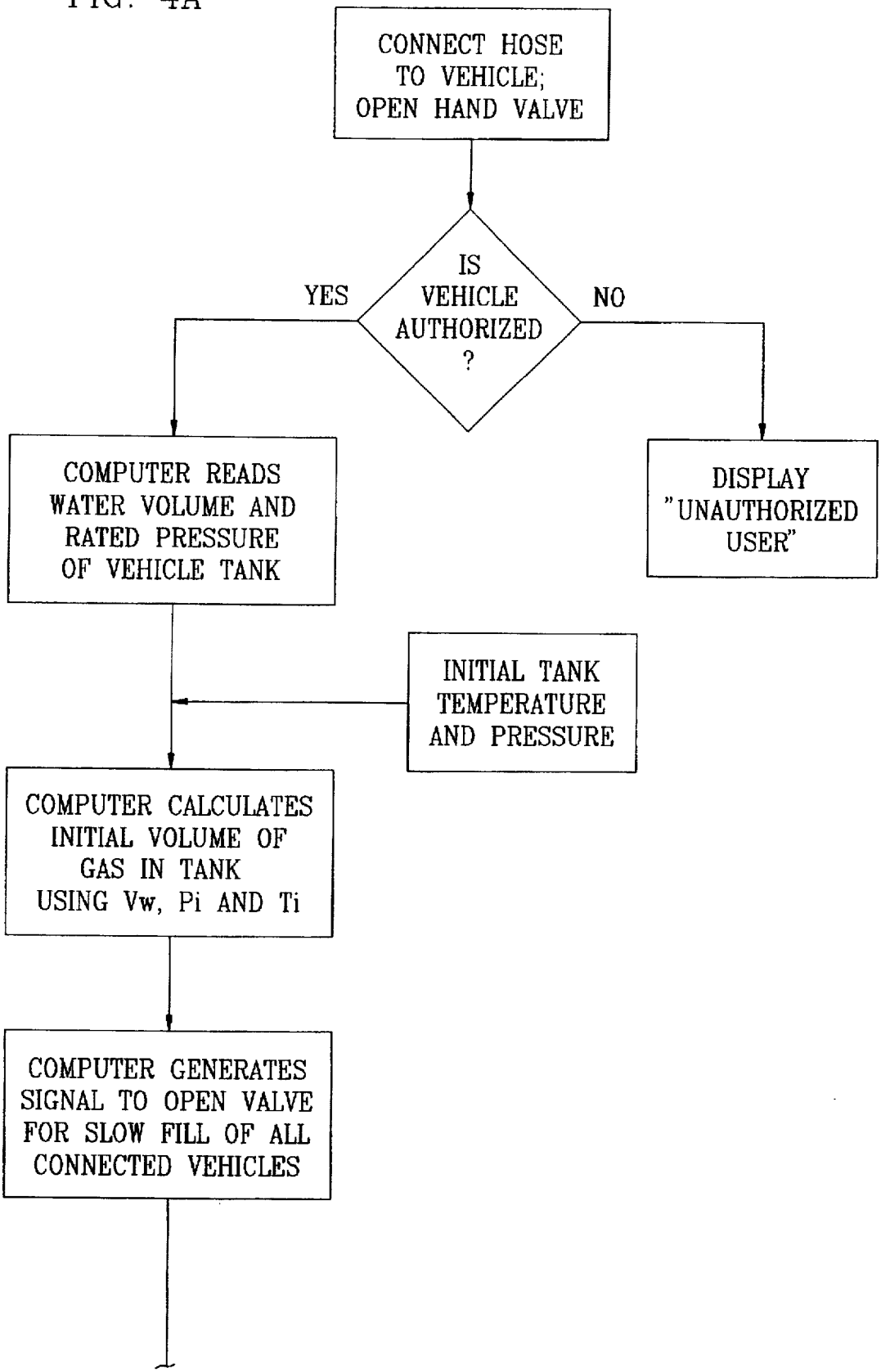
FIGS. 4A, 4B and 4C collectively comprise a simplified block flow diagram illustrating the steps of the method of the invention as practiced using the system of FIG. 3 for refilling vehicle storage tanks with a pressurized gas such as CNG.
Figure 4B:
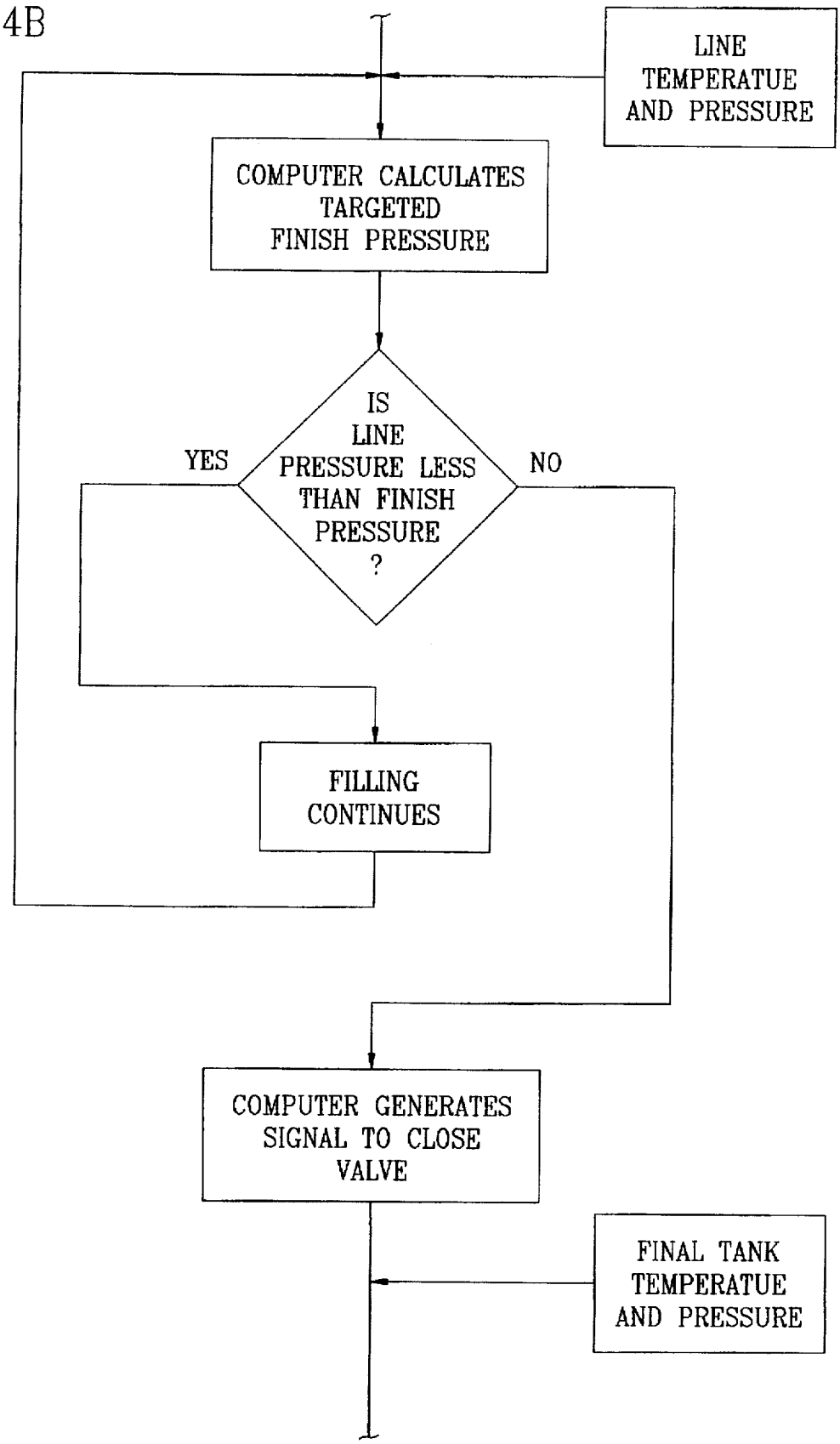
Figure 4C:
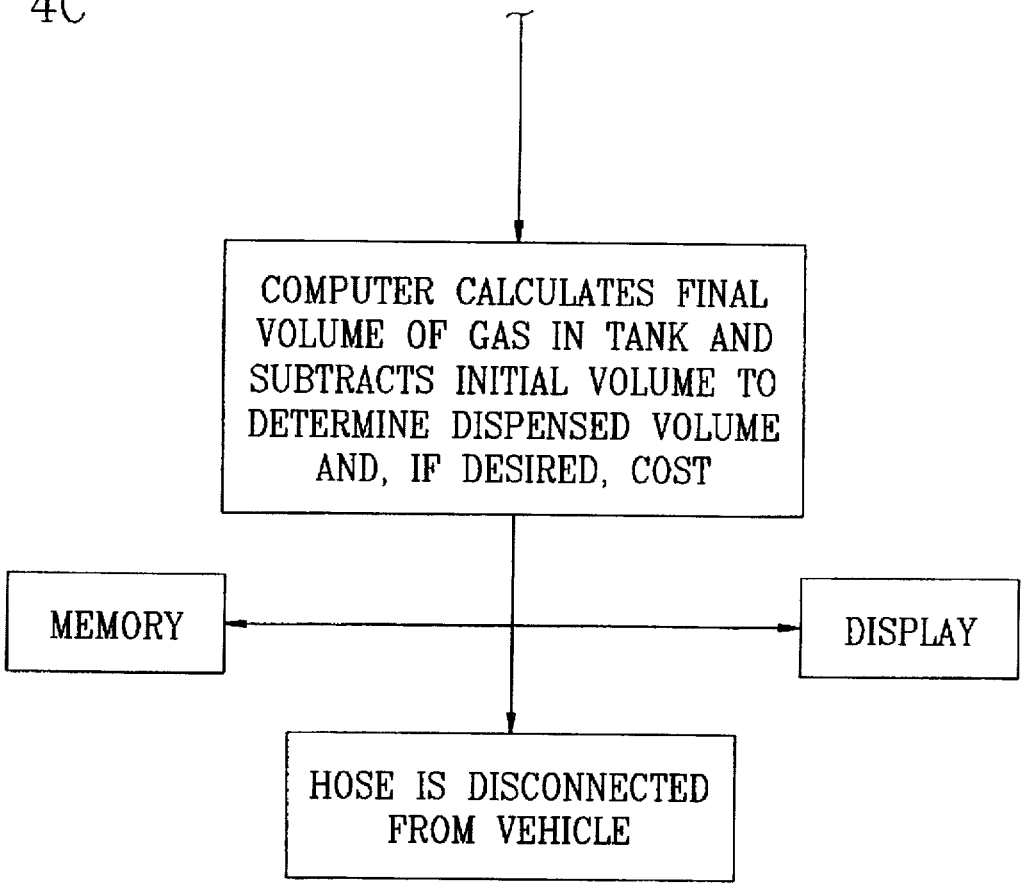

The method by which pressurized gas dispensing system 100 is used to "slow-fill" a plurality of receiving tanks is further described and explained in relation to FIGS. 4A to 4C. When hose connector assemblies 166 have connected each of receiving tanks 160, 162, 164 to dispensing manifold 114, three-way vent valves 170 are desirably opened and authorization procedures are desirably initiated as discussed above in relation to system 10 for reasons of safety and security. At this time, tank water volumes and pressure ratings for receiving tanks 160, 162, 164 can be transmitted to system computer 138 from vehicle data modules 174, 175, 176 through transmitter 176 and receiver 136 as previously discussed in relation to system 10, or by any other similarly effective means (one of which is described below in relation to system 200 of FIG. 9). Initial tank temperature and pressure data are also transmitted to computer 138 from temperature transducers 122 and pressure transducers 178, and computer 138 calculates initial gas volumes for each receiving tank 160, 162, 164. Computer 138 then signals solenoid 128 to open valve 120, permitting pressurized gas to flow through manifold 114, valves 170 and into receiving tanks 160, 162, 164. Because pressurized gas entering manifold 114 from pressurized gas source 112 will seek the path of least resistance, the receiving tank(s) having the lowest initial pressure will equalize with the other(s) before gas will begin entering the fuller tanks. As filling proceeds, temperature and pressure data are communicated to computer 138 through analog-to-digital converter 136, and computer 138 calculates the targeted finish pressure. Whenever the line pressure as sensed by pressure transducer 124 corresponds to the targeted finish pressure, computer 138 signals solenoid 128 to close valve 120, thereby terminating the flow of pressurized gas. Valves 170 are closed and computer 138 reads final tank temperature and pressure data received from temperature transducers 122 and pressure transducers 178, respectively. Computer 138 then calculates the final gas volume for each tank and determines the dispensed volume by subtracting the initial volume. Ancillary cost or mileage data, or the like, can then be generated and electronically stored, forwarded to display means 140 (including screens, printers, tapes, discs or any combination thereof), or transmitted back to vehicle data modules 173, 174, 175 by a means such as previously discussed in relation to system 10. Three-way vent valves 170 are then turned to the vent position, releasing gas trapped inside hose connector assemblies 166 to permit manual separation of the male and female connectors as previously described in relation to system 10.

If desired, system computer 138 of system 100 can be programmed so that if the pressure as determined by pressure transducer 124 drops by a predetermined amount (as might be experienced due to gradual cooling) prior to the time that the receiving tanks are disconnected from the refueling system, computer 138 will recalculate the estimated finish pressure and will signal solenoid 128 to reopen valve 120 to resume slow-filling the receiving tanks until the reestimated finish pressure is achieved.

Figure 9:
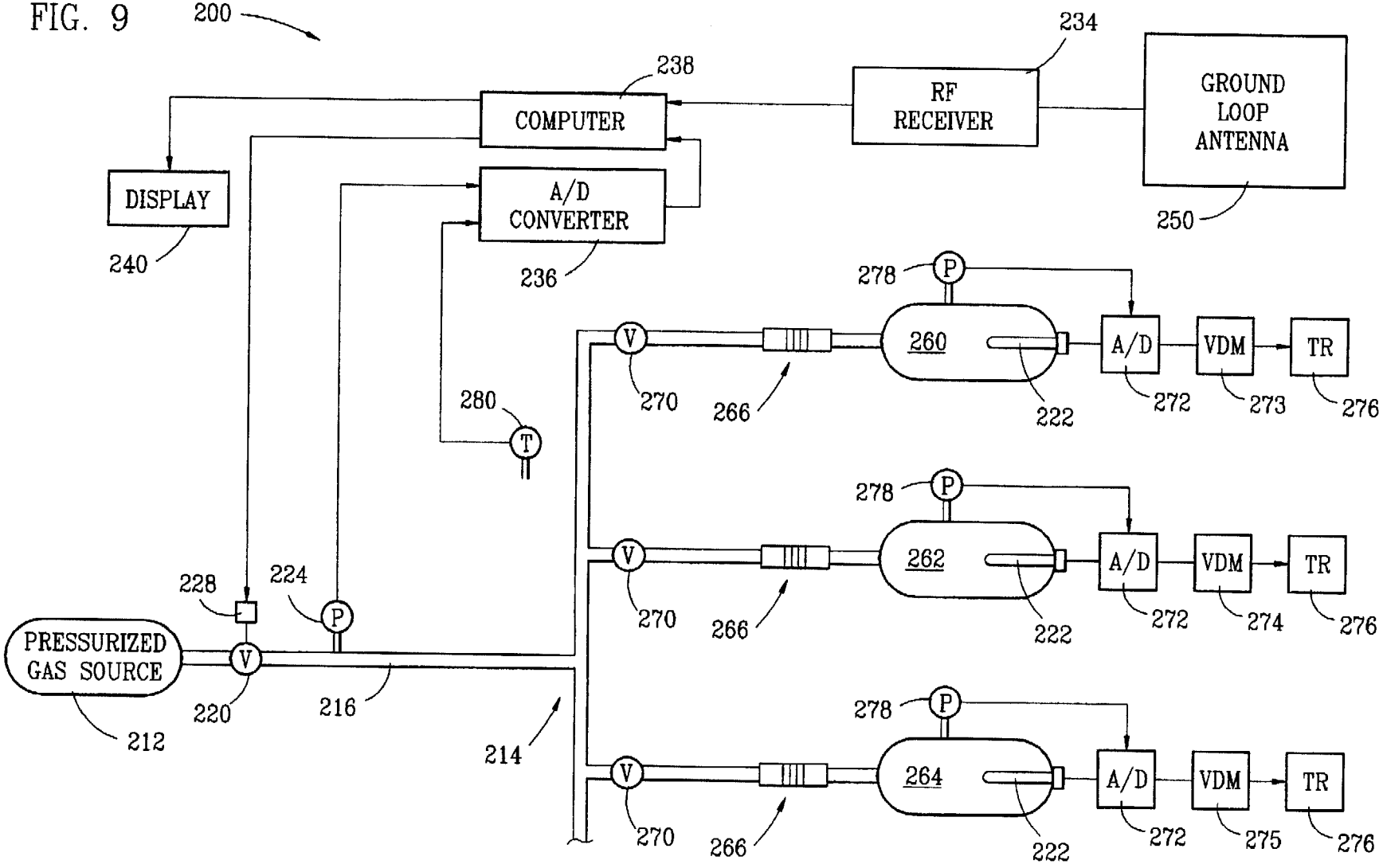
FIG. 9 is a simplified schematic view of another preferred embodiment of the compressed gas dispensing system of the invention as adapted for use in slow-filling a plurality of motor vehicle storage tanks with CNG.

Another preferred embodiment of the invention is described in relation to FIG. 9, which depicts pressurized gas dispensing system 200 comprising pressurized gas source 212, gas flow line 216, gas dispensing manifold 214, three-way vent valves 270, hose connector assemblies 266, ground loop antenna 250, RF receiver 234, computer 238, analog-to-digital converter 236, display 240, solenoid 228, valve 220, pressure transducer 224 and temperature transducer 280. According to this embodiment of the invention, temperature transducer is not in direct thermal contact with the gas supply line 216, but is disposed so as to measure ambient temperature at the refueling site. (It will be appreciated that this placement of the temperature transducer can also be used for temperature transducer 180 of system 100 as previously described.) Ground loop antenna 250 of system 200 is a preferred vehicle—specific authorization means that can be buried in the driveway entering the refueling area for use in downloading information such as vehicle identification, mileage, tank water volume, rated pressures, initial tank temperatures and pressures, and the like, from vehicle data modules 273 as vehicles approach the refueling area. The entryway to the refueling area is desirably constructed with an automated gate or other similarly effective means that will deny access to the refueling area for unauthorized vehicles. Receiving tanks 260, 262, 264 are desirably provided with temperature transducers 222, pressure transducers 278, analog-to-digital converters 272, vehicle data modules 273 and RF transmitters 276. With this embodiment of the invention, hose connector assemblies 266 do not comprise RF antennae, so ending tank temperature and pressure data from temperature transducers 222 and pressure transducers 278, or any other data not previously downloaded to the ground loop antenna 250, are transmitted to computer 238 from RF transmitters 276 to RF receiver 234 as vehicles exit the refueling area. The volume of dispensed gas is then determined by comparing the exit data to the entrance data. System 200 is otherwise configured and functions in the same way as system 100 previously described.

With the inventions disclosed herein, it is now possible to dispense pressurized gas, particularly CNG, for refueling motor vehicle storage tanks through either an automated point of sale ("POS") system or an automated fleet data management ("FDM") system as desired. With both systems, a computer is used to calculate the volume of gas dispensed through use of formulae involving the pressure, volume and temperature ("PVT") relationship of gases. For rapid-fill applications where adiabatic heating or other temperature changes are significant, the finish pressure can be updated during refueling in response to temperature changes inside the receiving tank. Data pertaining to vehicle identification, odometer readings, rated tank pressure, tank pressure, tank temperature, fuel utilization, and the like can be communicated to and from the computer as described above through the vehicle data module, through RF transmitters and receivers (above or below ground), through plug-in hard-wired connectors, or through other similarly effective means. With the automated POS system, the computer can be programmed to charge out the selling price to the purchaser through any combination of displays, printouts and/or electronic data storage that is desired. With the automated FDM system, the computer can be programmed to provide the fleet manager with periodic reports on specific vehicle performance, mileage, fuel utilization, hours of operation, and the like, using data received from the vehicle data module and from the temperature and pressure sensors disposed in the vehicle tanks. The systems and methods disclosed herein are also applicable to more advanced vehicular fuel systems utilizing both liquid and compressed gaseous fuels, and reports can also be generated regarding the time of operation, fuel quantities used, and mileage achieved with each fuel.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A system for dispensing pressurized gas from a pressurized gas source into a receiving tank, the system comprising:

a pressurized gas source;

at least one receiving tank;

means for releasably connecting the source to the tank;

means for sensing gas temperature inside the tank and for generating a signal corresponding thereto;

means for sensing gas pressure inside the tank and for generating a signal corresponding thereto;

a computer;

means for initiating a flow of pressurized gas into the tank;

means for communicating signals generated by the temperature and pressure sensing means to the computer in a form recognizable by the computer;

means within the computer for receiving and storing manufacturer's data for the water volume and rated pressure of the tank, for receiving and storing temperature and pressure data communicated to the computer by the temperature and pressure sensing means, for periodically calculating gas volume inside the tank at standard conditions based on tank temperature and pressure, for periodically calculating estimated tank finish pressure, and for comparing the actual tank pressure and calculated gas volume to the estimated tank finish pressure and corresponding gas volume for the tank; and means for terminating the flow of pressurized gas to the tank whenever the calculated volume of gas in the tank or the gas pressure in the tank reaches a predetermined value.

2. The system of claim 1 wherein the pressurized gas is compressed natural gas.

3. The system of claim 1 further comprising automated authorization means.

4. The system of claim 3 wherein the means for initiating a flow of pressurized gas into the tank comprises at least one valve and means for controlling the valve in response to a signal generated by the authorization means.

5. The system of claim 1 wherein the communicating means comprises electronic signal generating, transmitting and receiving means.

6. The system of claim 1 wherein the means for terminating the flow of pressurized gas to the tank terminates the flow whenever the volume of gas inside the tank reaches a predetermined value.

7. The system of claim 1 wherein the means for terminating the flow of pressurized gas to the tank terminates the flow whenever the gas pressure in the tank reaches a predetermined value.

8. The system of claim 1 comprising means for calculating and storing a value corresponding to the volume of gas inside the tank at standard conditions at any time after the flow of pressurized gas into the tank is initiated.

9. The system of claim 1 comprising means for calculating, displaying and storing the volume of gas dispensed into the tank.

10. The system of claim 1 comprising means for calculating, displaying and storing the cost of gas dispensed into the tank.

11. The system of claim 1 comprising means for simultaneously dispensing pressurized gas from the pressurized gas source to a plurality of receiving tanks.

12. The system of claim 1 comprising means for controlling the flow of pressurized gas from the pressurized gas source to the receiving tank at a desired flow rate.

13. The system of claim 3 wherein the receiving tank is a vehicle storage tank and wherein the automated authorization means is vehicle-specific.

14. The system of claim 1 wherein the means for sensing gas temperature inside the tank and for generating a signal corresponding thereto comprises a temperature transducer extending into the tank.

15. The system of claim 1 wherein the means for sensing gas pressure inside the tank and for generating a signal corresponding thereto is a pressure transducer in fluid communication with the tank.

16. The system of claim 1 wherein the means for releasably connecting the source to the tank comprises a flexible hose with a releasable connector means.

17. The system of claim 1 wherein the means for releasably connecting the source to the tank comprises a hose connector assembly with means for use in communicating receiving tank data to the computer.

18. A method for dispensing pressurized gas from a pressurized gas source into a receiving tank having a predetermined water volume and rated pressure; the method comprising the steps of:

reading and storing in a computer data for the predetermined water volume and rated pressure of the tank;

releasably connecting a gas flow conduit from the source to the tank;

sensing and communicating to the computer an initial temperature and pressure inside the tank;

calculating and storing an initial value for the volume of gas inside the tank at standard conditions;

initiating a flow of pressurized gas from the source into the tank;

periodically sensing and communicating to the computer the temperature and pressure of gas inside the tank;

periodically recalculating the volume of gas inside the tank at standard conditions;

periodically calculating an estimated finish pressure for the gas inside the tank;

comparing the actual tank pressure and calculated gas volume to the estimated tank finish pressure and corresponding gas volume for the tank; and terminating the flow of pressurized gas to the tank whenever the volume of gas in the tank or the gas pressure in the tank reaches a predetermined value.

19. The method of claim 18 wherein the pressurized gas is compressed natural gas.

20. The method of claim 18 further comprising the step of confirming user authorization prior to initiating the flow of pressurized gas.

21. The method of claim 18 comprising the step of terminating the flow of pressurized gas to the tank whenever the volume of gas inside the tank reaches a predetermined value.

22. The method of claim 18 comprising the step of terminating the flow of pressurized gas to the tank whenever the gas pressure inside the tank reaches a predetermined value.

23. The method of claim 18 comprising the step of simultaneously dispensing pressurized gas from the pressurized gas source to a plurality of receiving tanks.

24. The method of claim 18 comprising the step of controlling the flow of pressurized gas from the pressurized gas source to the receiving tank at a desired flow rate.

25. The method of claim 18 wherein the receiving tank is a vehicle storage tank.

26. The method of claim 18 comprising the steps of calculating, storing and displaying the volume of gas dispensed from the source into the tank.

27. The method of claim 18 comprising the steps of calculating, displaying and storing the cost of gas dispensed from the source into the tank.

28. A system for determining the amount of a predetermined pressurized gas dispensed from a pressurized gas source into a receiving tank having a tank wall and a known water volume, the system comprising:

means for determining the initial temperature and pressure inside the receiving tank;

means for calculating and storing a value for the initial volume of gas inside the receiving tank at standard conditions;

means for determining the final temperature and pressure inside the receiving tank;

means for calculating a value for the final gas volume inside the receiving tank at standard conditions; and means for determining the difference between the initial and final gas volumes inside the receiving tank.

29. The system of claim 28 wherein the means for determining the initial and final temperatures inside the receiving tank comprises a temperature transducer installed in the tank wall.

30. The system of claim 28 wherein the means for determining the initial and final pressures inside the receiving tank comprises a pressure transducer installed in the tank wall.

31. The system of claim 28 wherein the means for calculating the initial and final gas volumes inside the tank is a personal computer.

32. The system of claim 28 wherein the means for determining the difference between the initial and final gas volumes inside the receiving tank is a personal computer.

33. A method for refilling a receiving tank with a pressurized gas, the method comprising the steps of:

determining the supercompressibility factor for the pressurized gas;

determining the volume of the receiving tank;

determining the initial temperature and pressure inside the receiving tank;

calculating the volume of pressurized gas inside the receiving tank at standard conditions prior to refilling using the Ideal Gas Law as corrected for the supercompressibility of the pressurized gas;

initiating a flow of pressurized gas into the receiving tank;

determining a desired finish fill pressure based upon the temperature and pressure inside the receiving tank;

monitoring pressure inside the receiving tank during refilling;

terminating the flow of pressurized gas when the pressure inside the receiving tank reaches the desired finish fill pressure;

determining the final temperature and pressure inside the receiving tank;

calculating the volume of pressurized gas inside the receiving tank at standard conditions after refilling using the Ideal Gas Law as corrected for the supercompressibility of the pressurized gas; and determining the volume of gas dispensed during refilling by subtracting the volume of gas inside the receiving tank prior to refilling from the volume of gas inside the tank after refilling.

34. The method of claim 33 comprising the additional steps of monitoring the temperature inside the receiving tank during refilling and redetermining the desired finish fill pressure in response to temperature changes inside the receiving tank during refilling.

35. The method of claim 34 comprising the additional step of calculating the volume of pressurized gas inside the tank at standard conditions during refilling using the Ideal Gas Law as corrected for the supercompressibility of the pressurized gas.

36. The method of claim 35 wherein the flow of pressurized gas is terminated whenever the volume of pressurized gas inside the tank reaches a predetermined level.

37. The method of claim 33 comprising the additional step of reducing the flow of pressurized gas as the pressure inside the tank approaches the desired finish fill pressure.

* * * * *

UNITED STATES PATENT AND TRADEMARK OFFICE

CERTIFICATE OF CORRECTION

PATENT NO. : 5,628,349
DATED : May 13, 1997
INVENTOR(S) : David A. Diggins; Jack E. Brown It is certified that error appears in the above-indentified patent and that said Letters Patent is hereby corrected as shown below:

In Column 6, Line 54, please delete the word "Stäbli" and replace with the word --Stäubli--.

In Column 6, Line 66, please delete the word "be" after the words "Once gas flow line 16 has" and replace with the word --been--.

Signed and Sealed this

Twenty-ninth Day of July, 1997

Bruce Lehman

*Attest:*

BRUCE LEHMAN

*Attesting Officer*

*Commissioner of Patents and Trademarks*